United States Patent [19]

Lin

[11] Patent Number: 4,917,375

[45] Date of Patent: Apr. 17, 1990

[54] MOTORIZED TREADMILL SPEED CHANGER

[76] Inventor: Paul Lin, 212-1, Lin 37, Ping Chen Village, Ping Chen, Tao Yuau, Taiwan

[21] Appl. No.: 396,706

[22] Filed: Aug. 22, 1989

[51] Int. Cl.[4] ..... A63B 23/06

[52] U.S. Cl. ..... 272/69

[58] Field of Search ..... 272/69

[56] References Cited

U.S. PATENT DOCUMENTS

| | | | |
|---|---|---|---|
| 3,737,163 | 6/1973 | Sumrall | 272/69 |
| 4,645,197 | 2/1987 | McFee | 272/65 |
| 4,645,204 | 2/1987 | Berger | 272/137 |
| 4,685,666 | 8/1987 | Decloux | 272/70 |
| 4,712,791 | 12/1987 | Edwards | 272/73 |

*Primary Examiner*—Richard J. Apley
*Assistant Examiner*—David H. Willse
*Attorney, Agent, or Firm*—Armstrong, Nikaido, Marmelstein, Kubovcik & Murray

[57] ABSTRACT

An improved motorized treadmill speed changer, especially one which changes speed by dry friction, characterized by comprising an adjusting unit consisting of a handle bar, a pinion, a rack, a motor base slide and a U support, and a driving unit consisting of a motor, a friction cone and a friction wheel, and being constructed in such way that the speed of the revolving belt of the motorized treadmill can be changed steplessly and controlled by turning the handle bar.

2 Claims, 3 Drawing Sheets

MOTORIZED TREADMILL SPEED CHANGER

BACKGROUND AND SUMMARY OF THE INVENTION

There are two kinds of speed changers of conventional motorized treadmills. One changes the speed of the treadmill by adjusting the distance between the belt pulleys on the motor shaft and the treadmill roller. Obviously, this kind of speed changer has the following disadvantages: (1) Without the help of another person, it is impossible for the operator to turn the screw rod when running. (2) It needs a motor of greater power, namely, it consumes more electricity. (3) Its motor can not be started loadlessly because it has no separating mechanism. So elastic fatigue and slip will occur to the belt after being in tension for a long time and adjusted frequently. As a result, the life of motor and belt will be reduced. (4) It is not suitable for use by old people and patients who are recovering from illness because it can not be started from zero speed.

Another changes the speed of the treadmill by changing its voltage. This kind of motorized treadmill can be started from zero speed but the structure is too complicated. The need of motor of greater output results in higher consumption of electricity and the high cost of construction reduces its competitiveness.

In view of these disadvantages, the inventor tried hard to make improvements and developed the improved motorized treadmill speed changer which can be started from zero speed and change speed steplessly and freely.

So the main object of this invention is to provide an improved motorized treadmill speed changer of which the speed of the revolving belt can be changed easily by adjusting the engaging point of the friction cone on the motor shaft and the friction wheel on the roller of the treadmill.

Another object of this invention is to provide an improved motorized treadmill speed changer which has a greater speed range and is suitable for use by people of different physical conditions.

Still another object of this invention is to provide an improved motorized treadmill speed changer which can be started from zero speed and reach a speed as high as 1:1 (1 rotation of the motor shaft to 1 rotation of the roller of the treadmill).

Still another object of this invention is to provide an improved motorized treadmill speed changer of which the motor is of smaller power and is carried by a slide on a U support so that the cost of the treadmill can be reduced.

DETAILED DESCRIPTION OF THE PREFERRED EMBODIMENT

Figure 1:
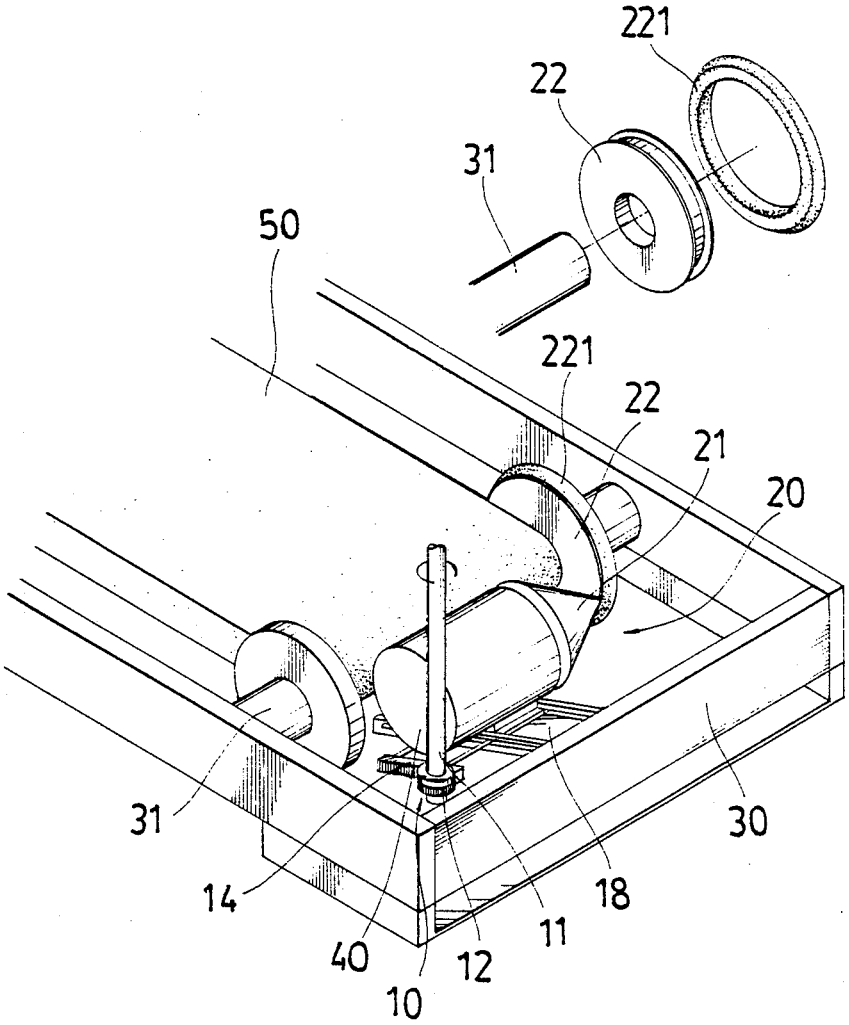
FIG. 1 is a vertical view of the improved motorized treadmill speed changer of this invention.
Figure 2:
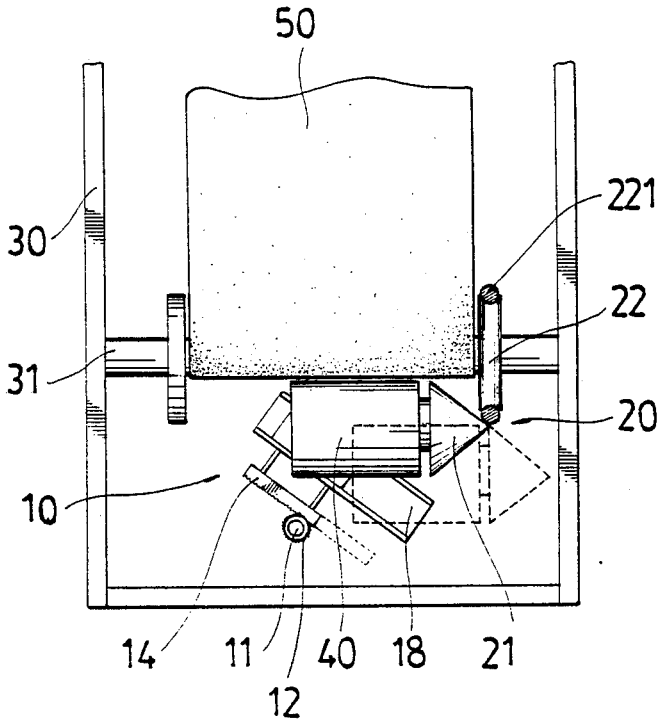
FIG. 2 is a top view of the said speed changer.
Figure 3:
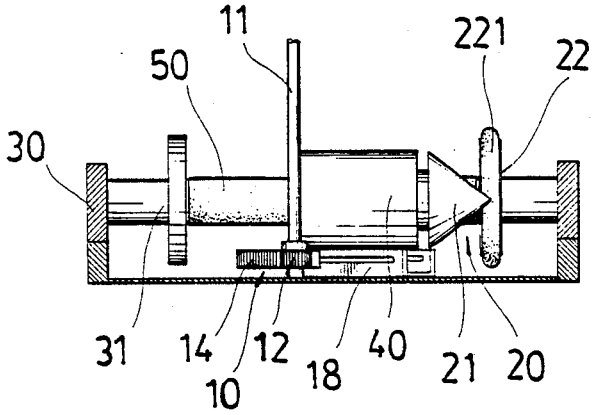
FIG. 3 is a sectional view of the said speed changer.
Figure 4:
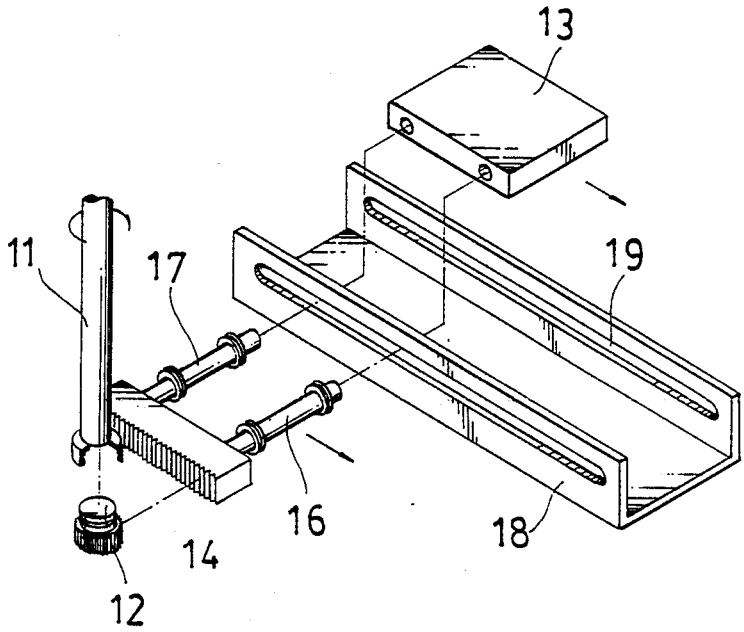
FIG. 4 is an exploded view of the adjusting unit of the said speed changer.
Figure 5:
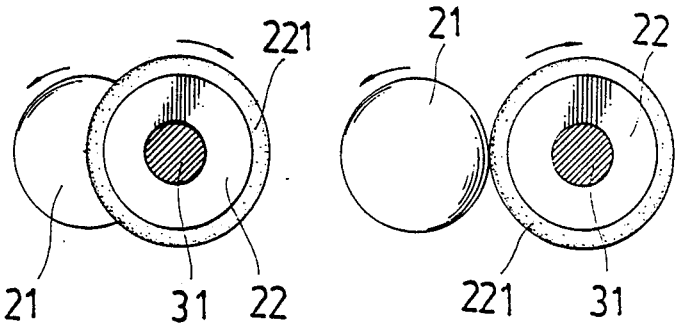
FIG. 5 illustrates the friction work of the friction wheel and friction cone of the said speed changer.

As shown in the drawings, the improved motorized treadmill speed changer of this invention comprises an adjusting mechanism 10 and a driving mechanism 20.

The adjusting mechanism 10 consists of a handle bar 11, a pinion 12. a rack 14, a motor base slide 13 and a U support 18. The handle bar 11 and the pinion 12 is pivotally mounted on the frame of the motorized treadmill. The U support 18 has two slot ways 19 in both sides and is diagonally fixed to the frame of the motorized treadmill. The rack 14 has two slide bars 16, 17 slidably fitted in the slot ways 19. The motor base slide 13 has two transverse holes to be fitted on the slide bars 16, 17. When the handle bar 11 and the pinion 12 is turned clockwise the engaged rack 14 and the motor base slide 13 with the motor 40 on will move forward and vise vera.

The driving mechanism 20 consists of a motor 40 mounted of the base slide 13, a friction cone 21 fixed to the shaft of the motor 40, and a friction wheel 22 fixed to the roller 31 of the endless belt of the motorized treadmill, the roller 31 being attached to frame 30. The friction wheel 22 is covered with a layer of colloid material 221 to act as a buffer to prevent from slipping when the friction wheel 22 is driven by the friction cone 21. Since the curved surface of the friction cone 21 tapers evenly to the apex, the speed of friction wheel 22 reduces with the contact point moving toward the apex. In other words, the speed of the friction wheel 22 is fastest when the friction wheel 22 engages the base of the friction cone 21 and slowest when the friction wheel 22 engages the apex of the friction cone 21.

In order to attain best friction and eliminate the stress resulted from friction, the adjusting mechanism 10 and driving mechanism 20 are so arranged that the line between the circumference of the base and the apex of the friction cone 21 is in alignment with the inner rim of the friction wheel 22 and parallel to the side of the U support 18.

When the friction cone 21 disengages the friction wheel 22, the endless belt 50 of the treadmill is pushed revolving by the weight of the operator who treads the mill. When the handle bar 11 and the pinion 12 is turned clockwise, the friction cone 21 on the motor shaft will advance with the forward movement of the rack 14 and slide 13 to engage the friction wheel 22. At this time, the endless belt 50 of the treadmill is driven by the motor. The speed of the revolving belt 50 increases with the advancing of the friction cone 22 and decreases with the retreating of the same. So the speed of of the revolving belt can be changed steplessly and controlled by turning the handle bar 11.

I claim:

1. An improved motorized treadmill speed changer comprising an adjusting unit and a driving unit; said adjusting unit consisting of a handle bar, a pinion connected to the handle bar and pivotally mounted on the frame of the treadmill, a U support having two slot ways in both sides and being diagonally fixed to the frame of the treadmill, a rack having two slide bars slidably fitted in the slot ways and a motor base slide having two holes to be fitted on the slide bars; said driving unit consisting of a motor mounted on the base slide, a friction cone fixed to the shaft of the motor, and a friction wheel fixed to the roller of the endless belt of the treadmill and covered with a layer of colloid material to act as buffer to prevent from slipping; said two units being so constructed that the line between the circumference of the base and the apex of the friction cone is in alignment with the inner rim of the friction wheel and parallel to the side of the U support so as to attain best friction and eliminate the stress resulted from friction and that the slide and the motor with the friction cone can be pushed back and forth by turning the handle bar and the speed of the revolving belt increases with the advancing of the friction cone and decreases with the retreating of the same so that the speed of the revolving belt can be changed steplessly and controlled by turning the handle bar.

2. An improved motorized treadmill speed changer according to claim 1 wherein the friction cone mounted motor shaft and the friction wheel mounted treadmill roller are on the same horizontal plane and the friction cone keeps contact with the rim of the friction wheel so as to achieve good transmission.

* * * * *